United States Patent [19]

Adriaansen et al.

[11] Patent Number: 4,792,195

[45] Date of Patent: Dec. 20, 1988

[54] DRAWER SUPPORT SYSTEM

[75] Inventors: David L. Adriaansen, Arlington; David L. Evans, Acton, both of Mass.

[73] Assignee: Kidde Holding, Inc., Saddlebrook, N.J.

[21] Appl. No.: 82,871

[22] Filed: Aug. 6, 1987

[51] Int. Cl.[4] ..... A47B 57/00

[52] U.S. Cl. ..... 312/245; 312/330 R; 312/338; 248/201

[58] Field of Search ..... 312/245, 211, 338, 335, 312/330 R, 237; 248/317, 201, 225.2

[56] References Cited

U.S. PATENT DOCUMENTS

| | | | |
|---|---|---|---|
| 3,033,638 | 5/1962 | Tomlinson | 312/338 |
| 3,973,814 | 8/1976 | Entrikin | 312/330 R |
| 4,440,461 | 4/1984 | Powell et al. | 312/338 |
| 4,540,146 | 9/1985 | Basile | 248/201 |
| 4,633,789 | 1/1987 | Kortering et al. | 312/245 |
| 4,666,113 | 5/1987 | Itoh et al. | 248/317 |

*Primary Examiner*—Victor N. Sakran
*Attorney, Agent, or Firm*—Darby & Darby

[57] ABSTRACT

An under cabinet storage system is provided with a relatively small number of modular components which may be assembled to form the support system for a large variety of heights and types of drawers. Among the supporting components is a bracket, a pair of which is mounted in opposed relationship so a to project below the cabinets, in order to support a drawer. Each bracket includes a plurality of vertically spaced slots, with a vertical array of stabilizing boxes on either side of the slot. Each drawer is supported by means of a pair of guide rails, one of which is provided on either side of the drawer for support. Each guide rail includes an upper and lower protruding tongue which is constructed to be received and retained within one of the slots in the bracket. On either side of the tongues, each guide rail is provided with a stabilizing lug which is received in one of the boxes on the bracket. The lugs and boxes are constructed with eyed elements, which assure that the guide rails are properly assembled to the brackets and make it impossible to assemble the support system improperly. In the preferred embodiment, two types of guide rails are provided, one type for a tilting drawer and the other type for an ordinary sliding drawer.

24 Claims, 3 Drawing Sheets

FIG. 1
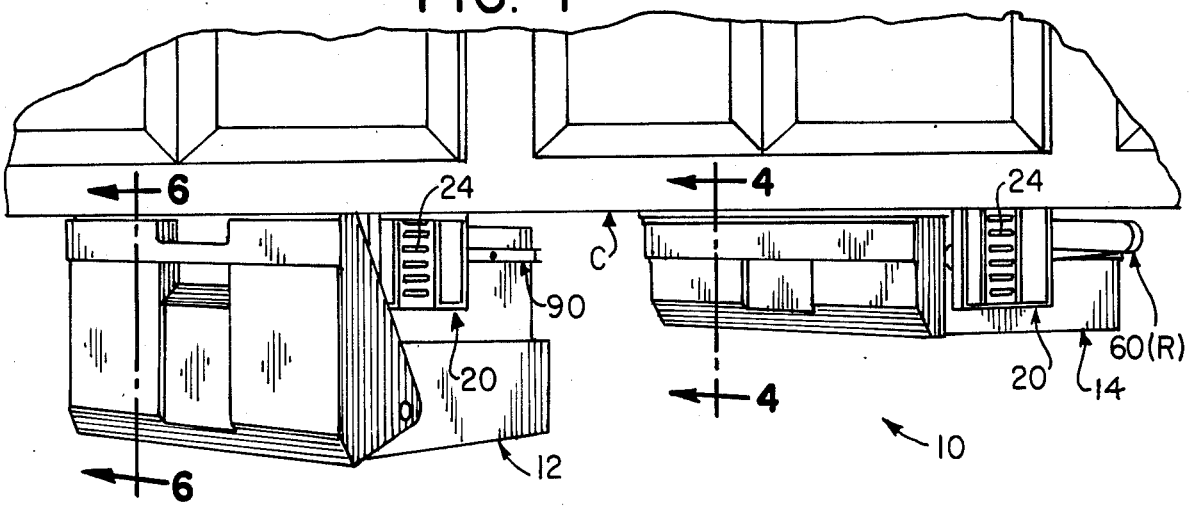
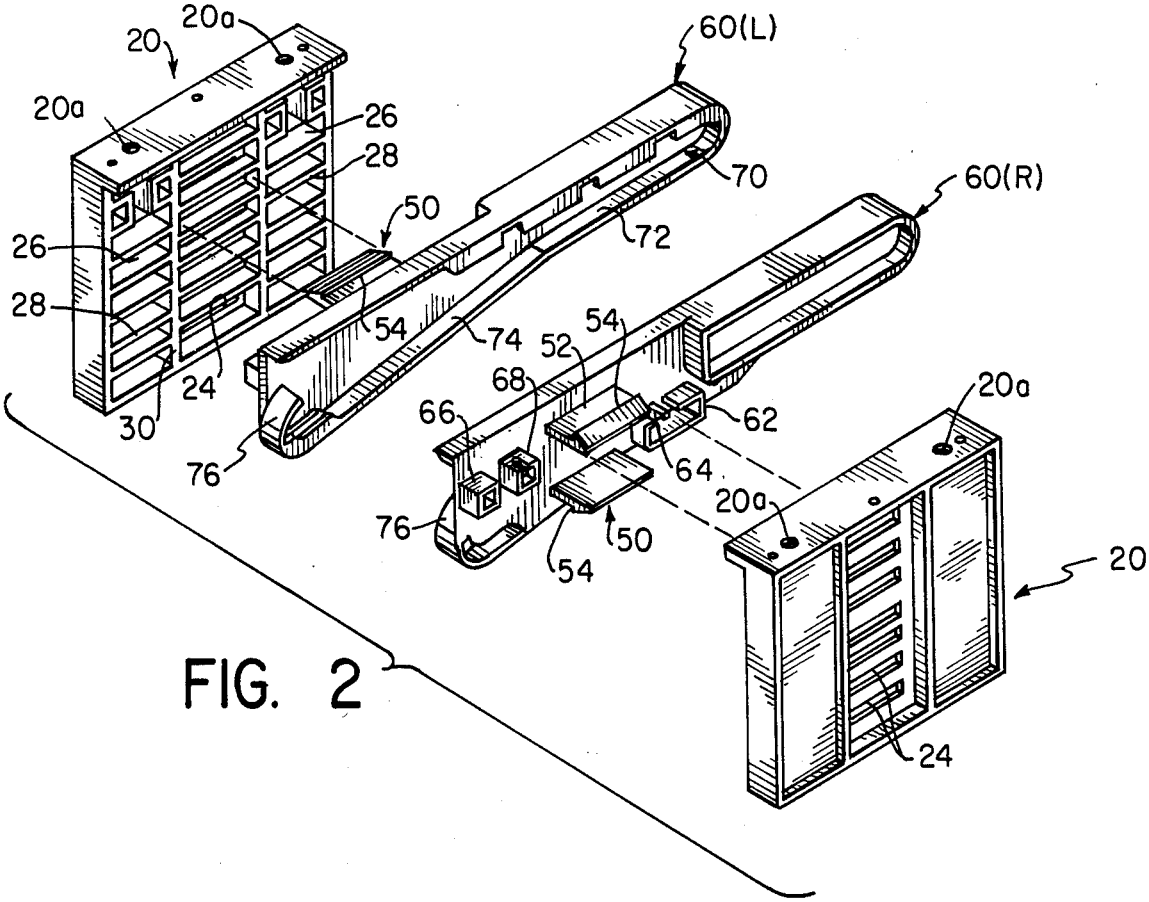
FIG. 2

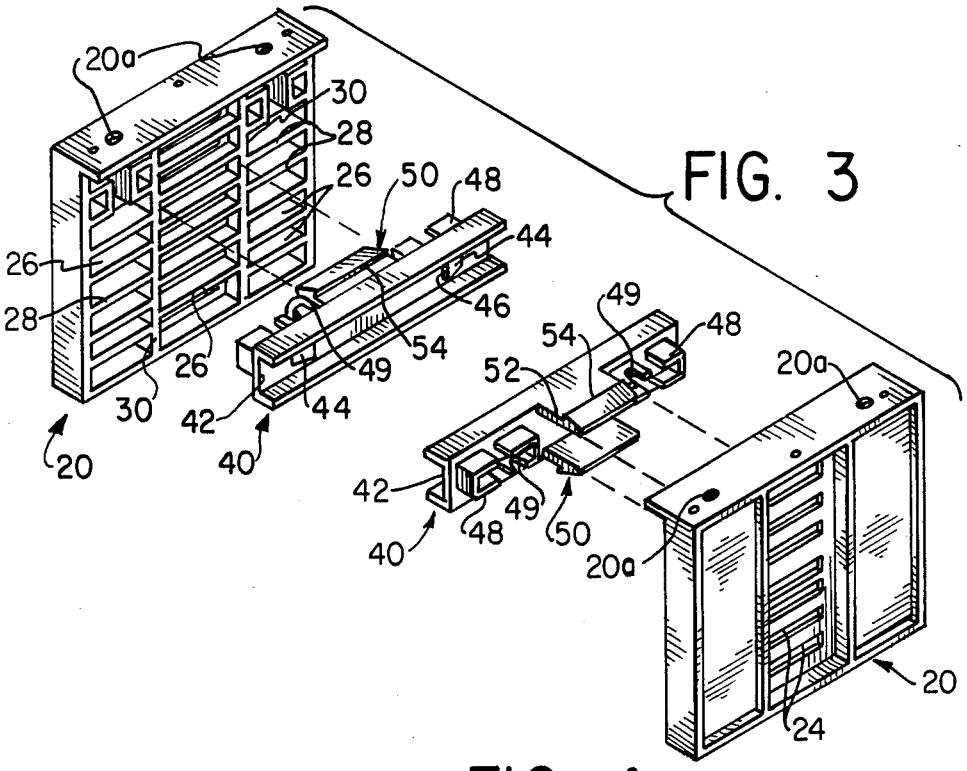
FIG. 3
FIG. 4
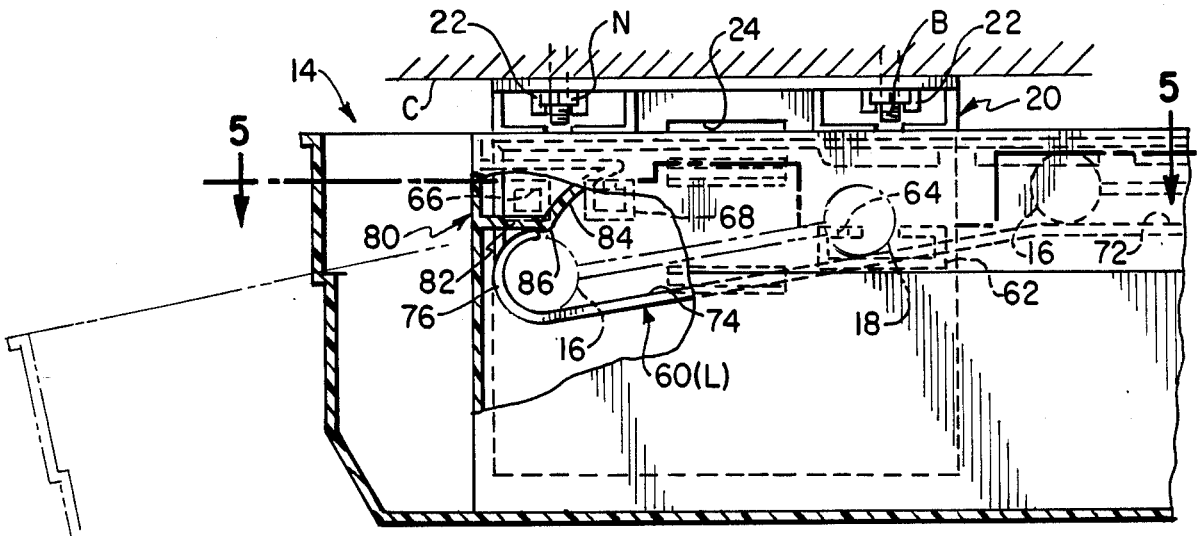
FIG. 5
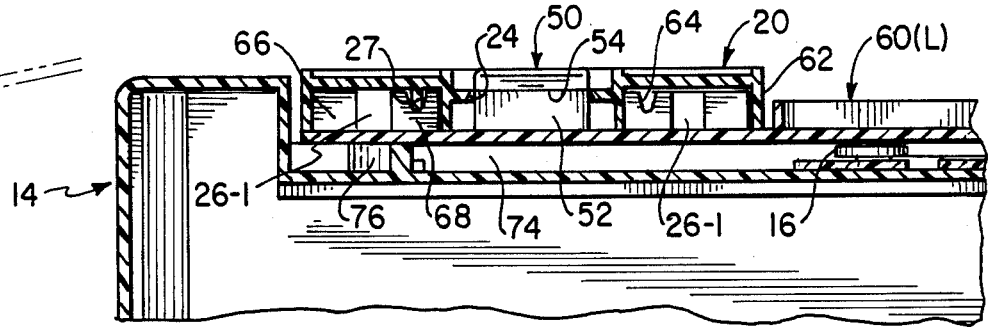

DRAWER SUPPORT SYSTEM

FIELD OF THE INVENTION

The present invention relates generally to furniture and, more particularly concerns a drawer support system which is used in supporting and mounting various types and sizes of drawers under kitchen cabinets, and the like.

BACKGROUND OF THE INVENTION

Under cabinet storage and, in particular, storage drawer systems mounted under kitchen cabinets, are becoming increasingly popular. A properly designed under cabinet drawer storage system can provide ample storage in previously unused space, without affecting the amount of useful space available in the kitchen. However, the particular needs and storage needs in different kitchens are widely variant, and a truly efficient storage system must be capable of meeting the specific needs of each kitchen. For example, the particular height of drawers required may vary from kitchen to kitchen and between different locations in any given kitchen. Furthermore, some drawers must be capable of tilting downwardly when pulled out, whereas others need only be capable of sliding in and out.

In general, the provision of an efficient drawer support system presents somewhat of a problem. Typically, it is necessary to provide a different type of support system for each different height of drawer as well as for each different type of drawer. For example, a drawer which tilts downwardly when pulled out must have a very different type of support system than a drawer which merely slides in and out. Accordingly, it has typically been necessary for under cabinet storage system manufacturuers to provide a large variety of drawer supporting a components, in order to accommodate all heights and types of drawers. Moreover, the need to manufacture and maintain an inventory of such a large assortment of drawer supporting components has represented a considerable expense to under cabinet storage system manufacturers which, until the present invention, could not be avoided. In addition, a certain amount of manual labor is required in order to select the combination of drawer supporting components which is to be provided to the customer who purchases a particular configuration of under cabinet storage system. This relatively expensive labor cost could also not be avoided until now.

Broadly, it is an object of the present invention to avoid the shortcomings of existing under cabinet storage systems. In particular, it is an object of the present invention to avoid the necessity of providing a large variety of drawer supporting components for an under cabinet storage system.

It is also an object of the present invention to avoid the need to select the particular drawer supporting components that must be provided with a particular configuration of under cabinet storage system.

It is yet another object of the present invention to provide a drawer support system for an under cabinet storage system which is reliable and convenient in use, yet relatively inexpensive in construction.

In accordance with a preferred embodiment of the present invention, an under cabinet storage system is provided with a relatively small number of modular components which may be assembled to form the support system for a large variety of heights and types of drawers. Among the supporting components is a bracket, a pair of which is mounted in opposed relationship so a to project below the cabinets, in order to support a drawer. Each bracket includes a plurality of vertically spaced slots, with a vertical array of stabilizing boxes on either side of the slot. Each drawer is supported by means of a pair of guide rails, one of which is provided on either side of the drawer for support. Each guide rail includes an upper and lower protruding tongue which is constructed to be received and retained within one of the slots in the bracket. On either side of the tongues, each guide rail is provided with a stabilizing lug which is received in one of the boxes on the bracket. The lugs and boxes are constructed with eyed elements, which assure that the guide rails are properly assembled to the brackets and make it impossible to assemble the support system improperly. In the preferred embodiment, two types of guide rails are provided, one type for a tilting drawer and the other type for an ordinary sliding drawer.

BRIEF DESCRIPTION OF THE DRAWING

The foregoing and further objects, features and advantages of the present invention will be more completely understood from the following description of a presently preferred, but nonetheless illustrative, embodiment of the invention, with reference being had to the accompanying drawing, in which:

FIG. 1 is a perspective drawing illustrating a simple under cabinet storage system which includes two different types of drawers;

FIG. 2 is an exploded view, on an enlarged scale, showing the components of a supporting system for a downwardly tilting drawer;

FIG. 3 is an exploded view, on an enlarged scale, illustrating the components of the support system for a simple sliding drawer;

FIG. 4 is a sectional view taken along line 4—4 in FIG. 1 and looking in the direction of the arrows;

FIG. 5 is a sectional view taken along contour of 5—5 in FIG. 4 and looking in the direction of the arrows;

DETAILED DESCRIPTION

Figure 6:
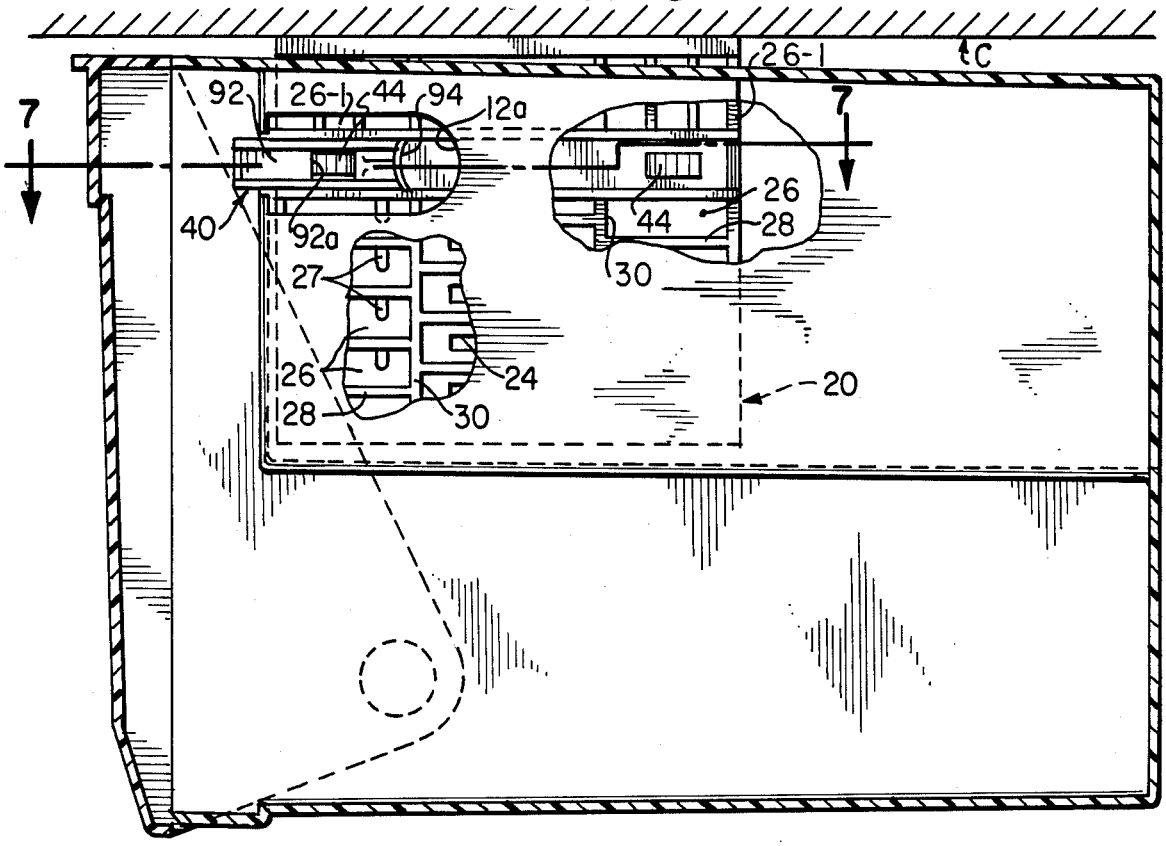
FIG. 6 is a sectional view taken along line 6—6 in FIG. 1 and looking in the direction of the arrows.

Referring now to the details of the drawing, there is illustrated an undercabinet storage system 10 illustrating objects and features of the present invention. The storage system 10 includes an 8 inch high bread box drawer 12 and a 4 inch high utility drawer 14. Both drawers are supported under a cabinet by means of a support system which permits the respective drawer to slide in and out. However, utility drawer 14 also tilts downward as it slides out (see e.g. the phantom portion of FIG. 4).

The support system for the drawers 12, 14 incudes a universal support bracket 20, which is constructed to be mounted below and to depend from the cabinet C. A pair of brackets 20, 20 are mounted in spaced relationship so as to provide support for each drawer. Each bracket 20 receives either a guide rail 40 (if a bread box drawer is to be supported) or a guide rail 60 (if a tilting drawer is to be supported). For reasons which will be explained further below, the bread box guide rails 40, 40 come in a single variety, whereas the tilting drawer guide rails come in a complimentary pair comprising a left hand guide rail 60(L) and the right hand guide rail 60(R). The guide rails 40 and 60 are constructed to be removably received within the brackets 20, 20 and to be positionable at different heights within the brackets so as to be capable of supporting drawers of different heights. Also, as will be explained in detail below, the guide rails and brackets are constructed so that the guide rails may not be positioned an in improper orientation (e.g. the tilting drawer guide rail cannot be inserted upside down).

The universal bracket 20 is preferably molded from plastic. It is conveniently mounted under the cabinet by means of bolts B mounted so as to extend down from the cabinet, and a small compartment 22 is provided near the front and rear at the top of each bracket, to receive a conventional nut N. The bracket 20 may then be secured to the cabinet by screwing the bolts into the nuts through a hole 20*a* which provides access to a nut in one of the respective compartments 22. The bracket 20 includes a plurality of vertically spaced, horizontal slots 24 arranged in a column. As will be explained more fully below, the slots cooperate with complimentary members on the guide rails to permit selective mounting of the guide rails to the brackets. On either side of the column of slots 24, the bracket 20 is provided with a column of stabilizing boxes 26. The boxes 26 on either side of the column of slots 24 are aligned with each. However, the boxes 26 are offset with respect to the slots 24, so that the dividing wall 28 between two vertically adjacent boxes 26 is aligned with a slot. In addition, each box 26 in the left hand column of boxes (as seen from the drawer side of the bracket) includes a vertical tab 27 (see FIG. 6) at a predetermined distance from the vertical wall 30 defining the column of boxes. Furthermore, the uppermost box 26-1 of each column is divided into separate left hand and right hand compartments.

The guide rails 40 and 60 are also preferably molded from plastic. Each of the guide rails includes a pair of resilient, outwardly protruding, opposed tongue members 50, 50 which are vertically spaced so as to be received in separate ones of the slots 24 in the bracket 20. On the guide rail 40, the tongue members 50, 50 are spaced so as to be received in adjacent ones of the slots 24, whereas in the guide rail 60, the tongue members 50, 50 are spaced so as to be received in a pair of slots 24, 24 which are separated by one slot. In either case, the tongue members are spaced so that the distance between the upper surface of the upper tongue member and the lower surface of the lower tongue member is essentially equal to the distance from the top wall of the upper receiving slot 24 to the bottom wall of the lower receiving slot 24. The tongue members 50, 50 are therefore received within their respective slots 24, 24 with a relatively close fit. In addition, each tongue member has a wedge-shaped forward portion 52. On the upper tongue member, the wedge-shaped portion protrudes above the upper surface of the tongue member and on the lower tongue member, the wedge-shaped portion protrudes below the lower surface of the tongue member. This defines an upright seating surface 54 at the rear of the wedge-shaped portion 52.

As a result of the above-described construction of the tongue members 50, when they are inserted into their respective slots 24, 24 and the guide rail is pressed against the bracket 20, the wedge-shaped portions 52, 52 of the respective tongue members 50, 50 cause the tongue members to be bent slightly towards each other as they pass through the slots 24, 24. After the wedge portions 52, 52 have passed beyond their respective slots 24, 24, the resilience of the tongue members 50, 50 causes them to straighten, bringing the seating surfaces 54, 54 into opposing relationship with the exterior wall of the bracket. The guide rail is therefore securely retained with respect to the bracket, and seating surfaces 54, 54 prevent the tongue members 50, 50 from being withdrawn from their respective slots 24, 24. Such withdrawal is possible, however, if the two tongue members are pressed together from the exterior of the bracket and simultaneously forced out of their respective slots 24, 24.

Each bracket 40 incudes a channel portion 42 which is constructed to receive a mating portion of the bread drawer 12 for sliding movement. At either end of the channel portion 42, there is provided a wedge-shaped projection 44. The protrusion of each projection 44 into the channel 42 increases in the direction away from the end of the channel, so that a seating surface 46 is formed behind each projection 44. Behind the channel portion and on either side of the tongue members 50, 50, there is provided a stabilizing lug 48 dimensioned to be received in one of the boxes 26. The two lugs would appear identical, if one of them were rotated 180° about an axis perpendicular to the bracket 20 in FIG. 3. Each lug 48 includes a slot 49 which is positioned and dimensioned to receiving one of the lugs 27 of the left hand boxes 26. From the preceding description, it will be appreciated that the bracket 40 is symmetrical with respect to a 180° rotation about an axis perpendicular to the bracket 20 in FIG. 3. It could therefore be inserted as shown in FIG. 3, or it could be turned upside down, and it would still fit properly within the bracket. In addition, the same guide rail 40 may be used either on the left hand bracket or on the right hand bracket. This eliminates the need for different types of straight guide rails.

The tilting drawer brackets 60 are provided in a left hand version 60(L) and the right hand version 60(R), which are mirror images of each other both on their outer faces and their inner faces. To the rear of the tongue members 50, 50, each of the guide rails 60 incudes a stabilizing lug 62 similar to the lugs 48 on guide rails 40. Like lug 48, lug 62 is dimensioned to fit within one of the boxes 26 in bracket 20, and it includes a slot 64 positioned and dimensioned to receive the tab 27 of one of the boxes 26. Forward of the tongue members 50, 50, are provided a pair of rectangular lug member 66, 68. The lug members 66 and 68 are dimensioned and spaced so as to be received together within one of the boxes 26 of bracket 20. However, they are not aligned with lug member 62 but are positioned sufficiently above it to be received in a box 26 which is one row above the box that receives the lug 62.

In addition, the lugs 66 and 68 are dimensioned to be received in the separate compartments of the compartmented upper boxes 26-1 of bracket 20. Thus, guide rail 60 may not only be mounted to bracket 20 at various vertical heights corresponding to different boxes 26, but it may also be mounted in the uppermost position of the bracket such that the lugs 66 and 68 are received within the box 26-1. Guide members 40 may not be mounted in this uppermost position, because the lug members 48 do not fit within the separate compartments of the box 26-1.

On its inner surface, each guide rail 60 includes a guide track 70 which receives a forward roller 16 and a rear roller 18 disposed at the top is the rear half of the drawer 14. Track 70 includes a generally horizontal rear portion 72 and a forwardly and downwardly inclined forward portion 74. At its forward end, forward portion 74 includes a terminating portion 76 which curves upwardly and rearwardly with a radius of curvature at least as large as the radius of roller 16 of the drawer 14.

Installation of an undercabinet storage system is started with the mounting of pairs of brackets 20 at appropriate positions under the cabinet to support the desired drawers. Thereafter, pairs of guide rails (40 or 60) are inserted at appropriate heights on the brackets for the drawers to be accommodated. These guide rails are simply snapped into an appropriate position on the respective bracket 20 and are held in place by means of the tongue members 50, 50 as explained above, with the various lug members aiding in stabilizing and supporting the guides. With the guides secured in place, the respective drawers may then be mounted in the guides.

In the case of a tilting drawer, forward and rear rollers 16, 18 are provided towards the top of the drawer and in the rear half thereof. The drawer is mounted in the guide members 60(L) and 60(R) by placing the front and rear rollers 16, 18 on the inclined portion 74 of track 70. With the drawer opened in this manner, the curved forward portion 76 of track 70 captures roller 16 and prevents the drawer from falling out. The drawer is then supported on the forward portion 74 of track 70 by means of the rollers 16 and 18 (shown in phantom in FIG. 4).

As the drawer is closed, the rollers 16 and 18 travel rearwardly up the inclined portion 74, and when the drawer is fully closed, both rollers 16 and 18 are on the horizontal rear portion 72 of track 70. Drawer 14 is provided with a rearwardly projecting locking member 80 which has a horizontal wall 82, a rearwardly and upwardly inclined wall 84, and a downwardly projecting lip at the apex of the walls 82 and 84. As drawer 14 is moved to a closed position, inclined wall 84 cooperates with upwardly curved forward portion 76 of guide rail 70 to assist in lifting the forward end of the drawer. As the drawer is pushed further inward, lip 86 follows the outer surface of forward portion 76. When the drawer is fully inward, lip 86 passes the edge of guide rail portion 76 and drops down behind it. As a result, drawer 14 is secured in position against accidental opening or opening due to its own weight. A normal pulling force or a pulling and lifting force will, however, lift the drawer sufficiently to raise lip 86 upward onto to rail portion 76, thereby permitting the drawer to slide open.

Figure 7:
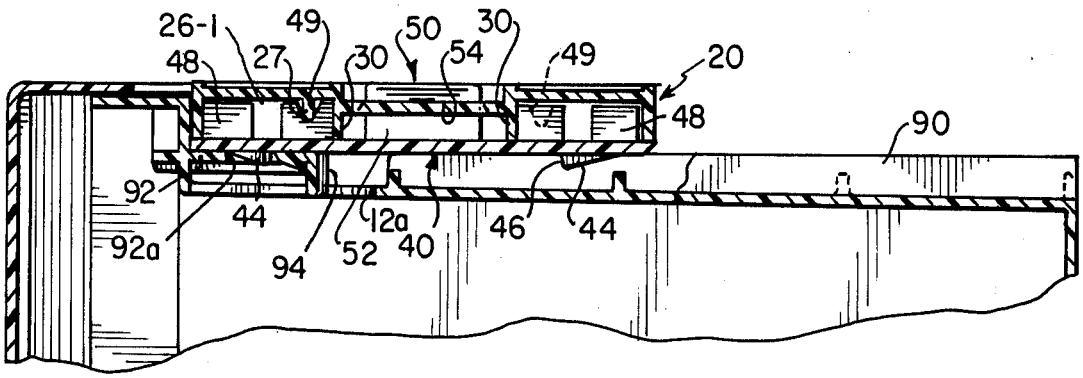
FIG. 7 is a sectional view taken along contour 7—7 in FIG. 6 and looking in the direction of the arrows.

A non-tilting drawer is provided with a straight, protruding rail 90 which is received in a channel 42 of a guide member 40. FIGS. 6 and 7 illustrate a bread box drawer 12 which is mounted in this manner. The bread drawer 12 has cut out 12*a* forward of, but adjacent to the rail 90, and a resilient finger 92 projects rearwardly from the front of the drawer within this cut out area. The resilient finger 92 is positioned so as to be aligned with the guide rail 90. At its rearmost end, finger 92 includes an inwardly projecting portion 94, and intermediate its ends, it has a rectangular opening 92*a*. Opening 92*a* is positioned to coincide with the projection 44 of guide rail 40 when the bread drawer 12 is fully closed. When the bread drawer is moved from an open to a close position, the end 94 of finger 92 eventually engages and slides along projection 44 and is bent inwardly, as a result of the wedge-shape projection of 44. When the opening 92*a* is aligned with the projection 44, finger 92 snaps back to its straightened position, whereby projection 44 is trapped within opening 92*a*, and seat 46 engages a side of opening 92*a*, to prevent removal of the bread drawer 12. The bread drawer 12 can then be utilized as a bread box by opening its swiveling front door D. In order to slide bread drawer 12 to its open position, it is necessary to open door D and to release the resilient finger 92 by pulling the rear portion 94 inwardly and forward.

Although a preferred embodiment of the invention has been disclosed for illustrative purposes, those skilled in the art will appreciate that many additions, modification and substitutions are possible, without departing from the scope and spirit of the invention as defined in the accompanying claims. For example, it will be understood that a typical drawer system would utilize more than two drawers and would not be limited to just a tilting drawer and a bread drawer. Typically, various types of tilting and non-tilting drawers would be included and these drawers could all be of different heights.

What is claimed is:

1. In an under cabinet storage system, a support subsystem for supporting storage enclosures under a cabinet comprising:

a pair of brackets mounted in spaced, opposed relationship under a cabinet, each bracket having a plurality of vertically spaced, horizontal slots, and a column of stabilizing boxes formed on either side of said slots;

a first pair of guide members disposed between said brackets and constructed to engage and retain one of said storage enclosures therebetween, each guide member having upper and lower spaced tongue means engaged within respective ones of said slots of a respective one of said brackets to releasably retain said guide member on said one bracket, and forward and rear lug means disposed on either side of said tongue means engaged within respective ones of said stabilizing boxes, said forward and rear lug means being within boxes on opposites sides of said slots, said tongue means being positioned so that said upper tongue means is above said lug means and said lower tongue means is below said lug means.

2. A system in accordance with claim 1, wherein said columns of boxes on each of said brackets are arranged so that corresponding boxes in different columns lie in a common row, with boxes in vertically adjacent rows sharing a common dividing wall, each row of boxes being positioned vertically intermediate two of said slots so that each slog is aligned horizontally with a dividing wall.

3. A system in accordance with claim 2, wherein the box in the upper row of each of said columns of boxes is divided into two side-by-side compartments.

4. A system in accordance with claim 1, wherein at least said boxes or said lugs are constructed so that said guide member can be inserted into a bracket in only selected, predetermined orientations.

5. A system in accordance with claim 4, wherein at least a subgroup of said boxes includes one of a tab member and a receiving slot in a predetermined location, at least one of said lugs including the other of a tab member and a receiving slot positioned to cooperate with said one thereof when said guide rail is positioned in said predetermined orientations with respect to said bracket.

6. A system in accordance with claim 1, wherein the upper of said tongue means of said guide rail includes an outermost wedge-shaped region protruding above the upper surface thereof and the lower tongue member includes an outermost wedge-shaped region protruding below the lower surface thereof, said wedge-shaped regions terminating abruptly so that an upright seating face is defined therebehind, said seating faces being disposed sufficiently outward on said tongue members to protrude through and beyond the respective slots of said bracket when said guide rail is mounted thereto, thereby preventing removal of said tongue members from their respective slots.

7. A system in accordance with claim 1, wherein each of said first pair of guide members has an inwardly directed channel for guiding a storage enclosure and said channel includes near one of its forward and rear ends an inwardly protruding wedgeshaped projection member, the protrusion of which increases towards the front-to-rear center of said channel, said projection member terminating abruptly at its furthest point from the respective one end of said guide rail channel to form a seating surface.

8. A system in accordance with claim 7, further comprising a storage enclosure including guide rails dimensioned and positioned to be slidingly received within each of said guide means, said storage enclosure including a resilient finger in general alignment with a guide rail, said finger having an opening therealong dimensioned to receive said wedgeshaped projection in the channel of one of said guide rails when said storage enclosure is in a predetermined position with respect to said guide rail, whereby said storage enclosure is locked against sliding movement with respect to said guide member.

9. A system in accordance with claim 1, wherein said columns of boxes on each of said brackets are arranged so that corresponding boxes in different columns lie in a common row, with boxes in vertically adjacent rows sharing a common dividing wall, each row of boxes being positioned vertically intermediate two of said slots so that each slog is aligned horizontally with a dividing wall.

10. A kit in accordance with claim 9, wherein the box in the upper row of each of said columns of boxes is divided into two side-by-side compartments.

11. In an under cabinet storage system, a support subsystem for supporting storage enclosures under a cabinet comprising:

a pair of brackets mounted in spaced, opposed relationship under a cabinet, each bracket having a plurality of vertically spaced, horizontal slots, and a column of stabilizing boxes formed on either side of said slots and arranged so that corresponding boxes in different columns lie in a common row, each row of boxes being positioned vertically intermediate two of said slots, the box in the upper row of each of said columns of boxes being divided into side-by-side compartments;

a first pair of guide members disposed between said brackets and constructed to engage and retain one of said storage enclosures therebetween, each guide member having upper and lower spaced tongue means for engagement within respective ones of said slots of a respective one of said brackets to releasably retain said guide member on said one bracket, and forward and rear lug means disposed on either side of said tongue means for engagement within respective ones of said stabilizing boxes, said forward and rear lug means being received within boxes on opposites sides of said slots; and at least one second pair of guide members disposed between said brackets and constructed to engage and retain one of said storage enclosures therebetween, each guide member having upper and lower spaced tongue means for engagement within respective ones of said slots of a respective one of said brackets to releasably retain said guide member on said one bracket, and forward and rear lug means disposed on either side of said tongue means for engagement within respective ones of said stabilizing boxes, said forward and rear lug means being received within boxes on opposites sides of said slots, said first pair of guide rails having a guide channel constructed to receiving a storage enclosure for front-to-rear sliding movement with respect thereto, said second pair of guide rails including a guide channel constructed to receive a storage enclosure for sliding and downward tilting front-to-rear movement with respect thereto.

12. A system in accordance with claim 11, wherein at least one of said lug members of said second pair of guide rails is constructed of smaller side-by-side lug members dimensioned to fit within the individual compartments of one of the boxes in said upper row.

13. In an under cabinet storage system, a support subsystem for supporting storage enclosures under a cabinet comprising:

a pair of brackets mounted in spaced, opposed relationship under a cabinet, each bracket having a plurality of vertically spaced, horizontal slots, and a column of stabilizing boxes formed on either side of said slots;

a first pair of guide members disposed between said brackets and constructed to engage and retain one of said storage enclosures therebetween, each guide member having upper and lower spaced tongue means for engagement within respective ones of said slots of a respective one of said brackets to releasably retain said guide member on said one bracket, and forward and rear lug means disposed on either side of said tongue means for engagement within respective ones of said stabilizing boxes, said forward and rear lug means being received within boxes on opposites sides of said slots; and at least one second pair of guide members disposed between said brackets and constructed to engage and retain one of said storage enclosures therebetween, each guide member having upper and lower spaced tongue means for engaging and within respective ones of said slots of a respective one of said brackets releasably retain said guide member on said one bracket, and forward and rear lug means disposed on either side of said tongue means for engagement within respective ones of said stabilizing boxes, said forward and rear lug means being received within boxes on opposites sides of said slots, said first pair of guide rails having a guide channel constructed to receive a storage enclosure for front-to-rear sliding movement with respect thereto, said second pair of guide rails including a guide channel constructed to receive a storage enclosure for sliding and downward tilting front-to-rear movement with respect thereto.

14. In an under cabinet storage system, a support subsystem for supporting storage enclosures under a cabinet comprising:

a pair of brackets mounted in spaced, opposed relationship under a cabinet, each bracket having a plurality of vertically spaced, horizontal slots, and a column of stabilizing boxes formed on either side of said slots;

a first pair of guide members disposed between said brackets and constructed to engage and retain one of said storage enclosures therebetween, each guide member having upper and lower spaced tongue means for engagement within respective ones of said slots of a respective one of said brackets to releasably retain said guide member on said one bracket, and forward and rear lug means disposed on either side of said tongue means for engagement within respective ones of said stabilizing boxes, said forward and rear lug means being received within boxes on opposites sides of said slots; and said guide member including a guide channel with a downwardly and forwardly sloping lower wall, said lower wall bending upwardly and rearwardly at its forward end, said system further comprising a storage enclosure including laterally projecting roller means positioned to be received on said bottom wall, said roller means being captured by said forward end of said bottom wall when said storage means is in a predefined, maximally opened position, said storage enclosure further including a rearwardly projecting guide element at its forward end, said guide element having a generally horizontal forward wall, an upwardly and rearwardly sloping rear wall, and a downwardly projecting lip at the apex of said walls, said lip being positioned to engage said upturned forward end of said bottom wall of said guide rail at an predefined edge thereof so as to retain said storage enclosure in a closed position, said sloped portion of said guide member cooperating with said upturned forward end of said guide rail to control downward tilting of said storage enclosure when it is initially opened.

15. A kit for installing under a cabinet a storage system including storage enclosures, said kit comprising:

a pair of brackets adapted to be mounted in spaced, opposed relationship under a cabinet, each bracket having a plurality of vertically spaced, horizontal slots, and a column of stabilizing boxes formed on either side of said slots;

a first pair of guide members constructed to engage and retain one of said storage enclosures therebetween, each guide member having upper and lower spaced tongue means for engagement within respective ones of said slots of a respective one of said brackets to releasably retain said guide member on said one bracket, and forward and rear lug means disposed on either side of said tongue means for engagement within respective ones of said stabilizing boxes, said forward and rear lug means being positioned to be received within boxes on opposites sides of said slots, said tongue means being positioned so that said upper tongue means is above said lug means and said lower tongue means is below said lug means.

16. A kit in accordance with claim 15, wherein at least said boxes or said lugs are constructed so that said guide member can be inserted into a bracket in only selected, predetermined orientations.

17. A kit in accordance with claim 16, wherein at least a subgroup of said boxes includes one of a tab member and a receiving slot in a predetermined location, at least one of said lugs including the other of a tab member and a receiving slot positioned to cooperate with said one thereof when said guide rail is positioned in said predetermined orientations with respect to said bracket.

18. A kit in accordance with claim 15, wherein the upper of said tongue means of said guide rail includes an outermost wedge-shaped region protruding above the upper surface thereof and the lower tongue member includes an outermost wedge-shaped region protruding below the lower surface thereof, said wedge-shaped regions terminating abruptly so that an upright seating face is defined therebehind, said seating faces being disposed sufficiently outward on said tongue members to protrude through and beyond the respective slots of said bracket when said guide rail is mounted thereto, thereby preventing removal of said tongue members from their respective slots.

19. A kit in accordance with claim 15, wherein each of said first pair of guide members has an inwardly directed channel for guiding a storage enclosure and said channel includes near one of its forward and rear ends an inwardly protruding wedgeshaped projection member, the protrusion of which increases towards the front-to-rear center of said channel, said projection member terminating abruptly at its furthest point from the respective one end of said guide rail channel to form a seating surface.

20. A kit in accordance with claim 19, further comprising a storage enclosure including guide rails dimensioned and positioned to be slidingly received within each of said guide means when mounted to brackets mounted under a cabinet, said storage enclosure including a resilient finger in general alignment with a guide rail, said finger having an opening therealong dimensioned to receive said wedge-shaped projection in the channel of one of said guide rails when said storage enclosure is in a predetermined position with respect to said guide rail, whereby said storage enclosure is locked against sliding movement with respect to said guide member.

21. A kit for installing under a cabinet a storage system including storage enclosures, said kit comprising:

a pair of brackets adapted to be mounted in spaced, opposed relationship under a cabinet, each bracket having a plurality of vertically spaced, horizontal slots, and a column of stabilizing boxes formed on either side of said slots;

a first pair of guide members constructed to engage and retain one of said storage enclosures therebetween, each guide member having upper and lower spaced tongue means for engagement within respective ones of said slots of a respective one of said brackets to releasably retain said guide member on said one bracket, and forward and rear lug means disposed on either side of said tongue means for engagement within respective ones of said stabilizing boxes, said forward and rear lug means being positioned to be received within boxes on opposites sides of said slots, and at least one second pair of guide members constructed to engage and retain one of said storage enclosures therebetween, each guide member having upper and lower spaced tongue means for engagement within respective ones of said slots of a respective one of said brackets to releasably retain said guide member on said one bracket, and forward and rear lug means disposed on either side of said tongue means for engagement within respective ones of said stabilizing boxes, said forward and rear lug means being positioned so as to be received within boxes on opposites sides of said slots, said first pair of guide rails having a guide channel constructed to receiving a storage enclosure for front-to-rear sliding movement with respect thereto, said second pair of guide rails including a guide channel constructed to receive a storage enclosure for sliding and downward tilting front-to-rear movement with respect thereto.

22. A kit in accordance with claim 21, wherein at least one of said lug members of said second pair of guide rails is constructed of smaller side-by-side lug members dimensioned to fit within the individual compartments of one of the boxes in said upper row.

23. A kit for installing under a cabinet a storage system including storage enclosures, said kit comprising:

a pair of brackets adapted to be mounted in spaced, opposed relationship under a cabinet, each bracket having a plurality of vertically spaced, horizontal slots, and a column of stabilizing boxes formed on either side of said slots;

a first pair of guide members constructed to engage and retain one of said storage enclosures therebetween, each guide member having upper and lower spaced tongue means for engagement within respective ones of said slots of a respective one of said brackets to releasably retain said guide member on said one bracket, and forward and rear lug means disposed on either side of said tongue means for engagement within respective ones of said stabilizing boxes, said forward and rear lug means being positioned to be received within boxes on opposites sides of said slots, and at least one second pair of guide members constructed to engage and retain one of said storage enclosures therebetween, each guide member having upper and lower spaced tongue means for engagement within respective ones of said slots of a respective one of said brackets to releasably retain said guide member on said one bracket, and forward and rear lug means disposed on either side of said tongue means for engagement within respective ones of said stabilizing boxes, said forward and rear lug means being positioned to be received within boxes on opposites sides of said slots, said first pair of guide rails having a guide channel constructed to receive a storage enclosure for front-to-rear sliding movement with respect thereto, said second pair of guide rails including a guide channel constructed to receive a storage enclosure for sliding and downward tilting front-to-rear movement with respect thereto.

24. A kit for installing under a cabinet a storage system including storage enclosures, said kit comprising:

a pair of brackets adapted to be mounted in spaced, opposed relationship under a cabinet, each bracket having a plurality of vertically spaced, horizontal slots, and a column of stabilizing boxes formed on either side of said slots;

a first pair of guide members constructed to engage and retain one of said storage enclosures therebetween, each guide member having upper and lower spaced tongue means for engagement within respective ones of said slots of a respective one of said brackets to releasably retain said guide member on said one bracket, and forward and rear lug means disposed on either side of said tongue means for engagement within respective ones of said stabilizing boxes, said forward and rear lug means being positioned to be received within boxes on opposites sides of said slots, and said guide member including a guide channel with a downwardly and forwardly sloping lower wall, said lower wall bending upwardly and rearwardly at its forward end, said kit further comprising a storage enclosure including laterally projecting roller means positioned to be received on said bottom wall when said guide member is mounted on a bracket mounted under a cabinet, said roller means being positioned to be captured by said forward end of said bottom wall when said storage means is in a predefined, maximally opened position, said storage enclosure further including a rearwardly projecting guide element at its forward end, said guide element having a generally horizontal forward wall, an upwardly and rearwardly sloping rear wall, and a downwardly projecting lip at the apex of said walls, said lip being positioned to engage said upturned forward end of said bottom wall of said guide rail at an predefined edge thereof so as to retain said storage enclosure in a closed position, said sloped portion of said guide member cooperating with said upturned forward end of said guide rail to control downward tilting of said storage enclosure when it is initially opened.

* * * * *